US009551043B2

(12) United States Patent
Van Haute et al.

(10) Patent No.: US 9,551,043 B2
(45) Date of Patent: Jan. 24, 2017

(54) METHODS OF MICROBIOLOGICAL CONTROL IN BEET SUGAR AND OTHER SUGAR-CONTAINING PLANT MATERIAL PROCESSING

(71) Applicant: Buckman Laboratories International, Inc., Memphis, TN (US)

(72) Inventors: Eddie Van Haute, Sint-Denijs-Westrem (BE); Jean Michel Chauwin, Villers-Plouich (FR); Marco Ulisse Mascia, Ravenna (IT)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 14/557,886

(22) Filed: Dec. 2, 2014

(65) Prior Publication Data

US 2015/0159230 A1 Jun. 11, 2015

Related U.S. Application Data

(60) Provisional application No. 61/912,037, filed on Dec. 5, 2013.

(51) Int. Cl.
*C13B 10/08* (2011.01)
*C13B 50/00* (2011.01)
(Continued)

(52) U.S. Cl.
CPC ..... *C13B 10/08* (2013.01); *C13B 10/006* (2013.01); *C13B 10/025* (2013.01); *C13B 10/083* (2013.01); *C13B 50/002* (2013.01)

(58) Field of Classification Search
None
See application file for complete search history.

(56) References Cited

U.S. PATENT DOCUMENTS 2,059,110 A 10/1936 Ioannu
4,038,372 A 7/1977 Colli
(Continued)

FOREIGN PATENT DOCUMENTS

WO WO 2008/083263 * 7/2008
WO WO 2010/109489 * 9/2010
WO WO 2014/114851 * 7/2014

OTHER PUBLICATIONS

Microbiological Counts during Beet Sugar Extraction S. Robles-Gancedo et al. Journal of Food Protection vol. 72, No. 6, pp. 1332-1337, 2009.*

(Continued)

*Primary Examiner* — Melvin C Mayes
*Assistant Examiner* — Douglas B Call
(74) *Attorney, Agent, or Firm* — Kilyk & Bowersox, P.L.L.C.

(57) ABSTRACT

Methods are described for producing sugar from sugar-containing plant material with microbiological control, which includes treating a sugar-containing plant raw material and/or a component derived therefrom, and/or a medium containing the plant raw material and/or the component, with monochloramine. Monochloramine usage in the method can reduce loss of sugar from bacterial consumptions in the processing of sugar-containing plant materials, such as sugar beets, without causing adverse effects on the sugar product, such as the brightness of white sugar.

16 Claims, 3 Drawing Sheets

(51) Int. Cl.
*C13B 10/00* (2011.01)
*C13B 10/02* (2011.01)

(56) References Cited

U.S. PATENT DOCUMENTS

| | | | | |
|---|---|---|---|---|
| 4,789,539 | A | 12/1988 | Osborg | |
| 6,222,071 | B1 | 4/2001 | Delalu et al. | |
| 7,045,659 | B2 | 5/2006 | Delalu et al. | |
| 7,070,751 | B2 | 7/2006 | Tummala et al. | |
| 2003/0196653 | A1 | 10/2003 | Sanders | |
| 2004/0086577 | A1* | 5/2004 | Delalu | C01B 21/091 424/661 |
| 2007/0277814 | A1* | 12/2007 | Klein | C13B 30/02 127/30 |
| 2008/0314379 | A1 | 12/2008 | Foraci | |
| 2010/0136132 | A1* | 6/2010 | van der Krieken | A01N 41/04 424/604 |
| 2013/0239953 | A1 | 9/2013 | Raimundo Filho | |
| 2013/0319627 | A1 | 12/2013 | Van Haute | |
| 2015/0351383 | A1* | 12/2015 | Kolari | A01N 37/34 514/528 |

OTHER PUBLICATIONS

International Search Report and Written Opinion issued in corresponding International Patent Application No. PCT/US2014/068095 dated Feb. 11, 2015 (14 pages).

Fuentes-Ramirez et al., "Acetobacter diazotrophicus, an indoleacetic acid producing bacterium isolated from sugarcane cultivars of Mexico," Plant and Soil, vol. 154, 1993, pp. 145-150.

Igwe et al., "Synergistic Effect of Monochloramine and Glutaraldehyde Biocides against Biofilm Microorganisms in Produced Water," Journal of Natural Sciences Research, vol. 3, No. 14, 2013, pp. 92-104.

Muthukumarasamy et al., "Effect of inorganic N on the population, in vitro colonization and morphology of Acetobacter diazotrophicus (syn. Gluconacetobacter diazotrophicus)," Plant and Soil, vol. 243, 2002, pp. 91-102.

International Preliminary Report on Patentability issued in corresponding International Patent Application No. PCT/US2014/068095 dated Jan. 8, 2016 (19 pages).

Written Opinion of the International Preliminary Examining Authority issued in corresponding International Patent Application No. PCT/US2014/068095 dated Nov. 4, 2015 (9 pages).

* cited by examiner

METHODS OF MICROBIOLOGICAL CONTROL IN BEET SUGAR AND OTHER SUGAR-CONTAINING PLANT MATERIAL PROCESSING

This application claims the benefit under 35 U.S.C. §119 (e) of prior U.S. Provisional Patent Application No. 61/912,037, filed Dec. 5, 2013, which is incorporated in its entirety by reference herein.

BACKGROUND OF THE INVENTION

The present invention relates to methods for microbiological control in the production of sugar from sugar-containing plant materials, and particularly relates to bacterial control in beet sugar processing.

Sugar (sucrose) and sugar products are primarily obtained from the vegetable raw materials, such as sugar beets and sugar cane, by mechanically disintegrating these plants and extracting, or pressing out, sugar-containing solutions from the plant parts. Sugar beet, cultivated *Beta vulgaris*, is a plant whose root contains a high concentration of sucrose.

Sugar beets, and other sugar-containing plants that are obtained from agricultural raw materials, are subject to microbiological decay through bacteria, yeasts, and fungi within certain temperature ranges, pH values, and concentration limits. There is a risk of infestation by microorganisms in food-technological processes related to sugar-containing plants, such as sugar beets, both during sugar production processing operations and during storage of raw, intermediate, and final products related to these operations. Microorganisms can degrade sugars contained in the raw materials and process materials to acids and gases to cause loss of sugar product, and/or cause elevated bacterial populations in the products. Microorganisms can influence the process negatively, not only by causing sugar losses, but also, for example, by causing pH drops and high lactic acid concentrations, which can affect other steps in the process (e.g., pressability of the pulp). Moreover, the process for the production of sugar from beets (or sugar cane) risks a microbial cleavage of the disaccharide sucrose into the monosaccharides glucose and fructose, which involves further disadvantages in addition to the immediate loss of sucrose, causing, for instance, a more intense coloration of the syrup, a higher need for alkalizing agents, and an increased amount of molasses.

At temperatures of less than about 50° C., the sugar-containing solutions can be subject to decay by all the microorganisms mentioned, i.e., bacteria, yeasts, and fungi. When extracting juices by thermal cell opening at temperatures above 50° C., only thermophilic bacteria typically are still capable of metabolic activity. The metabolic activity of the thermophilic bacteria can cause problems, and bacterial propagation (growth) can worsen the problems. An example of such a thermal extraction method is the widely-applied hot water extraction of sugar beets ("diffusing"), used in sugar production. In the sugar industry, formalin, dithiocarbamates, peracetic acid, ammonium bisulfate, and quaternary ammonium bases, have been used as antibacterial agents in juice flow or perishable intermediate products. These compounds may be relatively stable and remain in the treated materials and their products. For at least several years, the beet sugar processing industry has been using formaldehyde as a treatment agent. To control (thermophilic) bacterial action, for instance, the feed water to a diffuser in beet sugar processing has been dosed with formaldehyde. Formaldehyde is toxic and reduces the brightness of the white sugar product.

Thus, the present inventors determined that improved methods are needed for the sugar production industry, such as beet sugar processing, for the control of the microbiology, which does not adversely affect the brightness of white sugar or otherwise contaminate the sugar products, and which can be used as a potable-water approved technology to expand treatment opportunities and locations within a sugar production operation.

SUMMARY OF THE PRESENT INVENTION

It is therefore a feature of the present invention to provide a method for microbiological control in sugar production from sugar-containing plant materials.

Another feature of the present invention is to provide a method of using a monochloramine as a low oxidative and potable water approved technology for the control of bacterial contamination or other microbiological contamination in a beet sugar process to provide control of sugar loss due to bacterial sugar consumptions without adverse effects on the product.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates to a method for processing sugar from sugar-containing plant material with microbiological control, comprising treating at least one of a sugar-containing plant raw material, a component derived therefrom, or a medium containing at least one of the plant raw material and the component, with monochloramine.

The present invention further relates to a method for processing beet sugar in sugar production with microbiological control, comprising treating at least one of beet sugar raw material, a component derived therefrom, or a medium containing at least one of the beet sugar raw material and the component, with monochloramine. Monochloramine usage in the method can reduce loss of sugar from bacterial consumptions in the processing of sugar beets without causing adverse effect on the brightness of the white sugar product or other contamination.

It is to be understood that both the foregoing general description and the following detailed description are exemplary and explanatory only and are intended to provide a further explanation of the present invention, as claimed.

The accompanying drawings, which are incorporated in and constitute a part of this application, illustrate some of the features of the present invention and together with the description, serve to explain the principles of the present invention.

BRIEF DESCRIPTION OF THE DRAWINGS

The present invention may be more fully understood with reference to the accompanying figures. The figures are intended to illustrate exemplary features of the present invention without limiting the scope of the invention.

DETAILED DESCRIPTION OF THE PRESENT INVENTION

Figure 1:
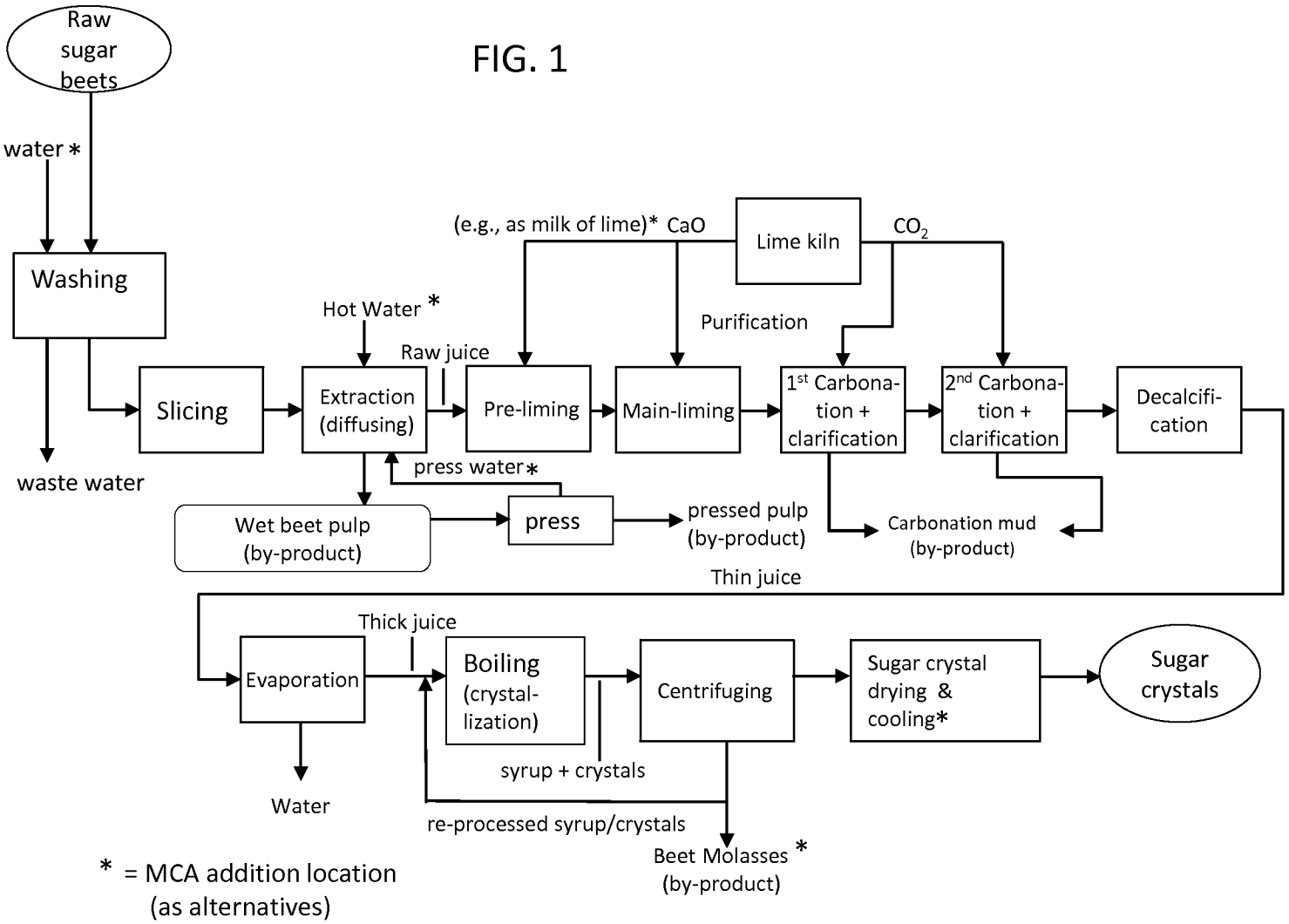
FIG. 1 is a process flow chart illustrating a method for beet sugar processing with microbiological control according to an example of the present invention.

In accordance with the present invention, a method is provided to preserve sugar by controlling microbiological sugar consumption during processing of sugar from sugar-containing plant material. The present invention also relates to a method to control microorganisms during sugar recovery operations from plant material. The term "plant" is used herein botanically unless indicated otherwise.

A key point in achieving effective control of the problems detailed above is using a monochloramine treatment, which can control bacterial sugar consumption in the processing of sugar-containing plant materials, such as sugar beets, without causing adverse effect on the brightness of the white sugar crystal product or other sugar product properties. Infection control can be provided through the monochloramine to reduce or eliminate the presence of sugar-consuming microorganisms, such as sugar-consuming bacteria. In addition to or alternatively to providing control of sugar losses, the monochloramine treatment of the present invention can reduce or prevent pH drops, increases in lactic acid concentrations, or both, which as indicated can adversely impact pulp pressability or cause other problems if not controlled. Control of the population of at least one species of bacteria can be provided, which reduces the population to a desired level (even to undetectable limits), and/or at least partially inhibits the growth of the bacteria. Further, as a potable approved material, the monochloramine can be dosed in non-topical or topical manners, or both, which expands the potential addition points of the treatment agent within a sugar production system. The monochloramine can be used to treat sugar-containing plant raw material, and/or a component derived therefrom, and/or a medium containing the plant raw material and/or the component, or any combinations thereof. Monochloramine can be added in water dilution form, which can facilitate its introduction into a wide variety of aqueous process streams, masses, and materials at different locations in a sugar production mill. Further, chloramine lacks a distinct chlorine odor, and so does not have an adverse effect on taste or other sensory attributes (unlike, e.g., chlorine treatments), and thus is more food-processing compatible. Further details, options, and examples are provided below.

Sugar beets are shown in the present application as a sugar-containing plant raw material that can be used as starting material in the methods in which microbiological control is provided. The method according to the present invention can be applied to sugar processing involving other types of sugar-containing plant raw materials, and not just sugar beets. The method of the present invention can be used in sugar production that involves sugar-containing vegetable materials such as, e.g., sugar beets, sugar cane, maize, sorghum, and the like, and/or sugar-containing fruit materials such as nectarines, pineapples, mangoes, jackfruit, peaches, cantaloupe, apricots, bananas, grapes, apples, pears, cherries, oranges, and the like, and/or sugar-containing tree sap/juices such as, e.g., maple tree sap/juice, sugar palm sap/juice, coconut sugar, or other sugar-containing plant materials, separately or in any combination thereof. Sucrose is stored in variety of plant species, which can include sugar beets (e.g., the fleshy root of *Beta vulgaris*), sugar cane (e.g., the fleshy stalks/stems of *Saccharum* sp.), sugar maple (e.g., tree sap of sugar maple (e.g., *A. nigrum*), black maple (e.g., *Acer saccharum*), and the like), maize, sorghum (e.g., stem juice/syrup of sweet sorghum, e.g., *Sorghum vulgare* var. *saccharatum*), and palms (e.g., palm sugars from tree sap of the gomuti (sugar) palm (e.g., *Arenga pinnata*), wild date palm (e.g., *Phoenix sylvestris*), the palmyra palm (e.g., *Borassus flabellifer*), and the like; and/or coconut sugar from the inflorescence of coconut palm (e.g., *Cocos nucifera*), and the like), and the above-indicated fruits, or other sucrose-containing plant species. Preferably, the methods of the present invention can be used in sugar production that yields dry flowable crystalline particulate sugar, liquid sugar concentrate, and/or other sugar products and by-products. The methods of the present invention can be used in sugar production that involves sucrose production from such sucrose-containing plant species or other sources. The methods can be used in the production of other types of sugars, such as fructose, glucose, and/or galactose, and the like, if contained in the indicated plant material sources and/or as obtained from other plant material sources that do contain them in recoverable quantities. In methods of the present invention, a single type of sugar (e.g., sucrose, or glucose, or fructose, or galactose, and the like) can be the predominant type (>50% by weight) of sugar produced, the only or essentially the only type of sugar produced, or sugar combinations of different types of sugars may be produced. A sugar product of methods of the present invention which produce sugar crystals, such as dry crystalline form sugar, can contain at least one specific type of sugar (such as sucrose, or glucose, or fructose, or galactose, and the like) in an amount of at least 25 wt %, or at least 50 wt %, or at least 60 wt %, or at least 70 wt %, or at least 80 wt %, or at least 90 wt %, or at least 95 wt %, or at least 99 wt %, or from 50-100 wt %, or from 50-99 wt %, or from 60-95 wt %, or 70-90 wt %, or other amounts (all on a solids basis). For sucrose production, for instance, the non-sucrose amounts, if present, may be non-sugar impurities, different sugars, or other materials, or combinations of these. These amounts can be based on pure sugar in a crystalline sugar product (e.g., white sugar), or other sugar product forms.

A sugar-containing plant raw material can be a sugar-containing plant material that has been (1) harvested and fleshy (tissue) parts thereof are optionally washed, optionally mechanically subdivided, or otherwise processed without yet removing a sugar component thereof by processing (e.g., sugar beets, cane sugar, whole fruits), or (2) collected as a raw natural sugar-rich liquid from a tree or fruit, such as tree saps/juices and/or fruit juices (e.g., maple syrup, palm sugars, coconut sugars, fruit juices). Sugar production processes where sugar (e.g., sucrose) is recovered from fleshy parts of harvested vegetable materials or fruit materials can include subdivision (e.g., slicing, chopping, and the like) and hot water extraction process steps before further processing to recover the sucrose (e.g., liming (carbonatation), clarification, evaporation, crystallization, and so forth such as shown herein). Sugar production processes that involve use of a collected raw natural sugar-rich liquid, such as fruit juices pressed from fruits and/or tapped tree saps/juices, can proceed directly to sugar recovery processing without need of mechanical slicing and hot water extraction steps. The collected raw natural sugar-rich liquid can receive monochloramine treatment for microbiological control and preservation of the liquid during storage until processed, such as during storage and until further processing. The further processing of the monochloramine-treated fruit juices may include demineralization, decolorization, chromatographic separations of different sugars, evaporation/concentration, crystallization for production of dry flowable crystalline particulate sugar, and/or other processing steps.

The method for producing sugar crystals or other sugar products from sugar-containing plant material with effective microbiological control can involve dosing a sugar production system at a total dosage (combined dosages, all addition points) of from about 1 g to about 1000 g monochloramine, or from about 3 g to about 1000 g monochloramine, or from about 10 g to about 1000 g monochloramine, or from about 50 g to about 1000 g monochloramine, or from about 100 g to about 1000 g monochloramine, or from about 1 g to about 500 g monochloramine, or from about 3 g to about 500 g monochloramine, or from about 10 g to about 500 g monochloramine, or from about 50 g to about 500 g monochloramine, or from about 1 g to about 300 g monochloramine, or from about 3 g to about 300 g monochloramine, or from about 10 g to about 300 g monochloramine, or from about 20 g to about 300 g monochloramine, or from about 30 g to about 300 g monochloramine, or from about 40 g to about 300 g monochloramine, or from about 50 g to about 300 g monochloramine, or other amounts, per ton (2000 lb.) of sugar-containing plant raw material or starting material processed by the system. The dosage can be constant or can vary in these ranges during production. The monochloramine amount can be an average monochloramine amount based on a 24-hour period, or other time period. The indicated treatment ranges are on a monochloramine basis. Other chloramines may be used in addition to monochloramine.

The monochloramine can be added in an aqueous diluted form at a concentration of from about 100 ppm to about 15,000 ppm, or from about 200 ppm to about 15,000 ppm, or from about 300 ppm to about 15,000 ppm, or from about 500 ppm to about 15,000 ppm, or from about 500 ppm to about 5000 ppm, or from about 1000 ppm to about 4500 ppm, or from about 1500 ppm to about 4000 ppm, or from about 2000 ppm to about 3500 ppm, or from about 2250 ppm to about 3250 ppm, or from about 2500 ppm to about 3000 ppm, or from about 500 ppm to about 13,000 ppm, or from about 600 to about 12,000 ppm, or from about 700 ppm to about 10,000 ppm, or from about 800 ppm to about 9,000 ppm, or from about 900 ppm to about 8000 ppm, or other ranges.

A chloramine treatment agent can be used which comprises, consists essentially of, or consists of at least one chloramine. The chloramine(s) can be, for example monochloramine (MCA)($NH_2Cl$), dichloramine (DCA), or a combination thereof. A majority (by weight) of the chloramine can be MCA (such as at least 50.1%, at least 60%, at least 70%, at least 80%, at least 90%, at least 95%, at least 99%, 90% to 100%, 95% to 100%, 99% to 100%, or 100% by weight of the chloramine present).

The monochloramine treatment can be performed in any suitable manner at each addition point in the sugar production system that is used. The treatment can be continuous, substantially continuous, intermittent, cyclic, batch, or any combination thereof. The treatment can be performed at one or more stages or locations in a sugar production system. In a sugar beet processing plant, the treatment can be performed in a vessel through which processed material passes. The monochloramine can be added directly into the vessel, or can be introduced indirectly via a process stream that then is fed into the vessel, or combinations thereof. The treatment may be applied in-line to a flowing process stream or mass without any accompanying dwell or residence period in a process vessel. A process vessel in a sugar production operation wherein the treatment can be applied is a washer, slicer, diffuser, sliced raw plant material heat exchanger, liming vessel, carbonating vessel, evaporating vessel, boiling vessel, drying vessel, dust catcher, storage vessel, and/or other process vessel, or any combination thereof. The monochloramine treatment(s) can occur directly on external surfaces of raw beet material (e.g., roots before slicing), such as by topical application of a treatment solution containing monochloramine. The treatment(s) can occur wherein sliced or at least partially disintegrated raw beet material mass and/or a sugar-containing component derived therefrom is present in a medium (e.g., as dispersed in an aqueous medium, such as an aqueous solution, juice, syrup, or as contained in a medium that is pulp or other flowable mass having aqueous content). The treatment(s) can occur where process water or other process fluid can be pre-treated with the monochloramine prior to being combined with at least one of a raw plant material, a sugar-containing component thereof, or another medium in which the raw plant material and/or sugar-containing component thereof is contained, dispersed, or massed. The monochloramine treatment(s) can occur in at least one or any combination of these locations in sugar production from sugar-containing plant materials.

The microorganisms that are controlled can be bacteria, fungi, yeasts, and/or archaebacteria, and/or other microorganisms that can consume sugar, such as in juices, pulps, syrups, or process water in beet sugar processing or other sugar production processes. The microorganisms that can be controlled with the monochloramine treatment can be predominantly bacteria, essentially entirely, or entirely bacteria. The bacteria that can be controlled can be classical aerobic bacteria, such as *Leuconostoc mesenteroides, lactobalillus, coccus*, or other bacterial species, or any combination thereof. Thermophilic microorganisms may be controlled with the monochloramine treatment. The thermophilic microorganisms that may be controlled are *bacillus, thermos*, and *chlostridia* species, or other species, or any combination thereof.

With the present invention, the treated process water, fluid, juice, syrup, pulp, or other material has very low bacteria count. The bacteria can be present at less than about 0.1 colony forming units (cfu) per gram of dry weight content of plant material and/or components thereof contained in the treated material (d.w.), less than about 10 cfu/g treated plant material and/or components d.w., less than about 1,000 cfu/g treated material d.w., less than about $1.0\times10^5$ cfu/g treated plant material and/or components d.w., less than about $1.0\times10^6$ cfu/g treated plant material and/or components d.w., less than about $1.0\times10^8$ cfu/g treated plant material and/or components d.w., less than about $1.0\times10^{10}$ cfu/g treated plant material and/or components d.w., less than about $1.0\times10^{12}$ cfu/g treated plant material and/or components d.w., less than about $1.0\times10^{15}$ cfu/g treated plant material and/or components d.w.

The monochloramine or other chloramine can be obtained from any suitable source. The monochloramine can be formed as a stock solution, such as an aqueous dilute form thereof, which can be introduced to process water and/or an aqueous medium containing sugar-containing plant material or sugar-containing components thereof. The monochloramine can be formed in-situ in stock solution or process water. The monochloramine can be formed on-site or off-site. For example, OXAMINE 6150, BUSPERSE 2454 product, BUSAN 1215 product, and BUCKMAN 1250 product, available from Buckman Laboratories International, Inc., Memphis, Tenn., can be used as precursors to form monochloramine. The monochloramine can be prepared accordingly to any suitable method. For example, monochloramine can be produced by one of the techniques described in U.S. Pat. Nos. 4,038,372, 4,789,539, 6,222,071, 7,045,659, and 7,070,751, which are incorporated herein in their entireties. The monochloramine can be formed by reacting dilute ammonia solution or at least one ammonium salt or other nitrogen source with at least one chlorine-containing oxidant. The monochloramine can be formed by reacting a dilute ammonia solution with sodium hypochlorite, calcium hypochlorite, or other hypochlorite source, or any combination thereof. Monochloramine can be prepared by adding an ammonia solution and sodium hypochlorite to dilution water to achieve a 1 to 1 molar ratio of ammonia and sodium hypochlorite. Monochloramine can be prepared, for example, by combining about 1 fluid volume part OXAMINE 6150 to about 2.3-3 fluid volume parts of bleach. Commercial bleaches can contain concentrations of sodium hypochlorite which can be up to 18.0% wt/wt sodium hypochlorite, e.g., about 14%-18% wt/wt NaOCl, or other concentrations thereof. The monochloramine can be formed by reacting at least one ammonium salt with sodium hypochlorite or other hypochlorite source. For example, the ammonium salt can be ammonium bromide, ammonium sulfate, ammonium hydroxide, ammonium chloride, or a combination thereof. Monochloramine can be produced by reacting 1 to 1 molar ratio of the ammonium salt and chlorine. Monochloramine can be produced on-site at a sugar mill using such reactions, and used immediately or stored before use. Monochloramine can be produced off-site, and transported on-site for use.

For on-site production of monochloramine, a method and apparatus can be used for mixing at least two reactants or components, such as dilute ammonia solution and sodium hypochlorite, to form the desired reaction product. The apparatus can comprise preparatory makedown unit equipment. The apparatus can include a reactor, a reactor system, a generator, a small-volume generator, a vessel, an in-line mixer, or the like. The method and apparatus can be useful in controlling reactions that may be inherently dangerous, for example, wherein the mixing of the components has the potential to produce hazardous compounds or components. Precautions can be taken to ensure that the molar ratio of each reactant is precisely metered, as well as incoming makeup water if used in the reaction. As an example, the method and apparatus can be used for mixing an ammonia-containing chemical (e.g., ammonia) and a hypochlorite-containing chemical (e.g., hypochlorite), the nature of which is inherently dangerous. The mixing of an ammonia-containing chemical and a hypochlorite-containing chemical can be controlled carefully to avoid the production of hazardous compounds such as dichloramine, trichloramine, and chlorine gas.

The equipment used for mixing the at least two reactants or components, such as dilute ammonia solution and sodium hypochlorite, to form monochloramine, optionally can include an automated control mechanism. The control mechanism can relate one or more process control parameters to a monitored reaction condition, such as temperature. A differential temperature method of controlling an exothermic or endothermic chemical reaction optionally can be used. The chemical reaction can be an exothermic reaction, and the temperature difference can be a temperature increase. The chemical reaction can be an endothermic reaction, and the temperature difference is a temperature decrease. The method can include measuring a temperature of a first reactant flowing at a first flow rate, contacting the first reactant with a second reactant, and then measuring the temperature of a reaction product formed by a reaction between the first and second reactants. The temperature difference between the measured temperature of the first reactant and the measured temperature of the reaction product can be used to monitor the reaction, and adjustments can be made based on the temperature difference. The flow rate of the first reactant can be adjusted based on the temperature difference. The second reactant can be made to flow at a second flow rate, and the flow rate of the first reactant and/or the second reactant can be adjusted based on the temperature difference. The first temperature reading can optionally be right at the initial time that the reactants are brought together or some other time if desired. The second reading, used to obtain the temperature differential, can be a time where maximum temperature increase or decrease occurs from the reaction (e.g., the maximum increase from the exothermic reaction or maximum decrease from the endothermic reaction, whichever the case may be). This temperature difference from the reaction can be used to determine and/control the reaction to ensure that the reaction and the product from the reaction is the desired reaction product (e.g., monochloramine) and/or to ensure that reaction is proceeding in an efficient or correct manner. The apparatus can be configured to produce any amount of monochloramine including, but not limited to, 20 pounds or more of monochloramine per day, or less than this amount.

FIG. 1 is a process flow chart that shows a method for the production of sucrose (sugar) from sugar beets which includes introduction of chloramine for treatment at one or more locations within the system for microbiological control, such as bacterial control. Methods of extracting sugar from sugar beet, or other natural sugar sources such as sugar cane, usually involve the washing the plant material to remove soil and other external contaminants, slicing or otherwise subdividing of the washed plant material, and "diffusing" the sliced material with hot water to extract sugar from the cells of the sugar beet. A mechanical slicing unit can be used which cuts each individual sugar beet into a plurality of thin strips or chips conventionally known as "cossettes." Sugar cane additionally may be milled before extraction. Many different machines and components may be used in connection with the extraction system. The extraction system can comprise placing the cossettes in contact with a counter-current flow of heated water (e.g. at a temperature greater than about 50° C., e.g., about 65° C.-85° C., or other heated temperatures), in order to cause the diffusion of sugar-containing materials from the cossettes into the water. As a result, a raw beet juice product is produced which normally includes a considerable amount of beet tissue particles, and also water soluble materials (including sugar (sucrose) compositions), such as about 13-16 wt. % by weight water soluble materials or other amounts thereof. The counter-current movement in the diffuser may be caused by a rotating screw or the whole rotating unit, or other means such as known in the industry, and the water and cossettes move through internal chambers. These counter-current exchange methods can extract more sugar from the cossettes using less water than if they merely sat in a hot water tank (though that manner of extraction additionally can be encompassed by the present invention). The liquid exiting the diffuser, i.e., the extracted sugar-containing solution, is referred to as raw juice. The color of raw juice can vary from black to a dark red depending on the amount of oxidation, which can itself be dependent on diffuser design. The used cossettes, or pulp, can exit the diffuser at high moisture content, such as about 95 wt. % moisture, but low sucrose content. Using screw presses, for example, the wet pulp then can be pressed, such as down to 75 wt. % moisture or other reduced moisture contents. This can recover additional sucrose in the liquid pressed out of the pulp, and can reduce the energy needed to dry the pulp. The pressed pulp can be dried and optionally used as animal feed or other uses, while the liquid pressed out of the pulp can be combined with the raw juice, or can be re-introduced into the diffuser in the countercurrent process. Though not shown in FIG. 1, the raw juice product may be thereafter passed through a physical separation apparatus, such as those known in the industry, to remove beet juice particles and other suspended solid materials therefrom before further processing of the raw juice.

As shown in FIG. 1, the raw juice can next be purified before sugar crystal production. The raw juice can contain organic and inorganic non-sugar impurities including plant derived substances, minerals, salts and proteins, including both dissolved and undissolved solids, other than sucrose. The impurities can be removed at least partially, since proper crystallization of the sugar can be affected considerably by the degree of impurity of the raw juice. A process for removal of non-sugar impurities from the raw juice is known as liming and carbonation and is based on calcium carbonate co-precipitation. These can be multi-stage operations, and a lime kiln often is provided on-site to provide lime (CaO) and $CO_2$ for these respective operations. The calcium carbonate is produced by adding the lime and $CO_2$ in stages to the raw juice. The lime can be added to the raw juice in the form of milk of lime (e.g., heated milk of lime). The precipitated chalk and non-sugar impurities are filtered out, and the calcium concentration is further reduced by decalcification, such as by using ion exchange technology, to provide thin juice. Although not illustrated in FIG. 1, filtration, such as membrane filtration, activated carbon filtration, and the like, may be performed on the raw juice product before liming, and/or after liming, and/or other process locations, for purifying or clarifying the juice. After the purification, the thin juice can be heated, such as to about 110° C. to 120° C., and transported to an evaporator, where the water is removed from the solution. The thin juice is concentrated in an evaporator, such as a multi-stage steam evaporator, in order to raise the sugar content, such as from about 10-16% by weight to about 60-70% by weight, to provide thick juice. The thick juice is further concentrated by boiling under conditions that allow for crystallization (e.g., under vacuum, with seeding, etc.). Boiling is used to concentrate the thick juice into a thick crystal mixture, wherein sugar crystals are suspended in syrup. The boiling can take place at low steam pressure and lower temperature in order to avoid caramelization. The resulting crystals can be separated from the syrup by centrifugation. The recovered crystals are wet white sugar crystals, which are dried, such as with hot air (e.g., in a rotating granulator), and cooled, stored and/or packed. The drying operation can include a sugar dust catcher, such as equipment used for this purpose in the industry. It usually is not feasible to crystallize all of the sucrose in the thick juice as commercially acceptable sugar product. The syrup separated from the crystals by centrifugation can be re-processed to produce more sugar crystals, which tend to be of lower quality, and are redissolved in the thick juice. Other syrup is separated as beet molasses, which still contains sugar, but contains too much impurity to undergo further processing economically. Beet molasses can be used for fermentation, animal feed, or discarded.

The molasses may be further used as a raw material for fermentation to ethanol or other products. Sugar processing with monochloramine treatment performed upstream of where the molasses by-product is withdrawn from the system generally has no impact on biological fermentation that follows where the molasses is used as starting material to produce alcohol. In addition to treating the beet sugar production process, molasses that has been withdrawn from the sugar production system can be treated with monochloramine to preserve it during storage before usage. The molasses can be stored for long periods of time (e.g., up to 12 months storage or longer), before further use in an ethanol fermentation process or other uses. The addition of the monochloramine to the molasses can provide microbiological control during such storage and until used. In ethanol fermentation processing, after the removal of the desired fermentation product, the remaining spent wash residue material can be referred to as stillage or vinasse. Monochloramine can be added to the stillage to provide microbiological control therein. The above-indicated monochloramine dosages and concentrations can be used for these treatments, or other treatment amounts that provide microbiological control.

As indicated, the treating with monochloramine in the indicated process flow for beet sugar production, such as illustrated in FIG. 1 but not limited thereto, can occur at a one or more addition points within the system, such those locations or stages indicated by "*" in the figure, and/or right before these locations and/or right after these locations. The monochloramine may be added to one or more of wash fluid used on the raw beets before slicing, process water fed to the diffuser, pressed pulp water recycled to the diffuser, a purification fluid such as milk of lime, at dust catchers at the sugar crystal drying stage, and/or other locations, or at single site or any combination of these sites. Preferred addition points are those which can allow monochloramine to be added in a fluid medium, such as an aqueous form, e.g., a water dilution form, to contact the sugar beet material, a medium which contains sugar beet material or an extract and/or other part(s) thereof, or other process materials or equipment, or any combination of these and/or other addition locations.

Figure 2:
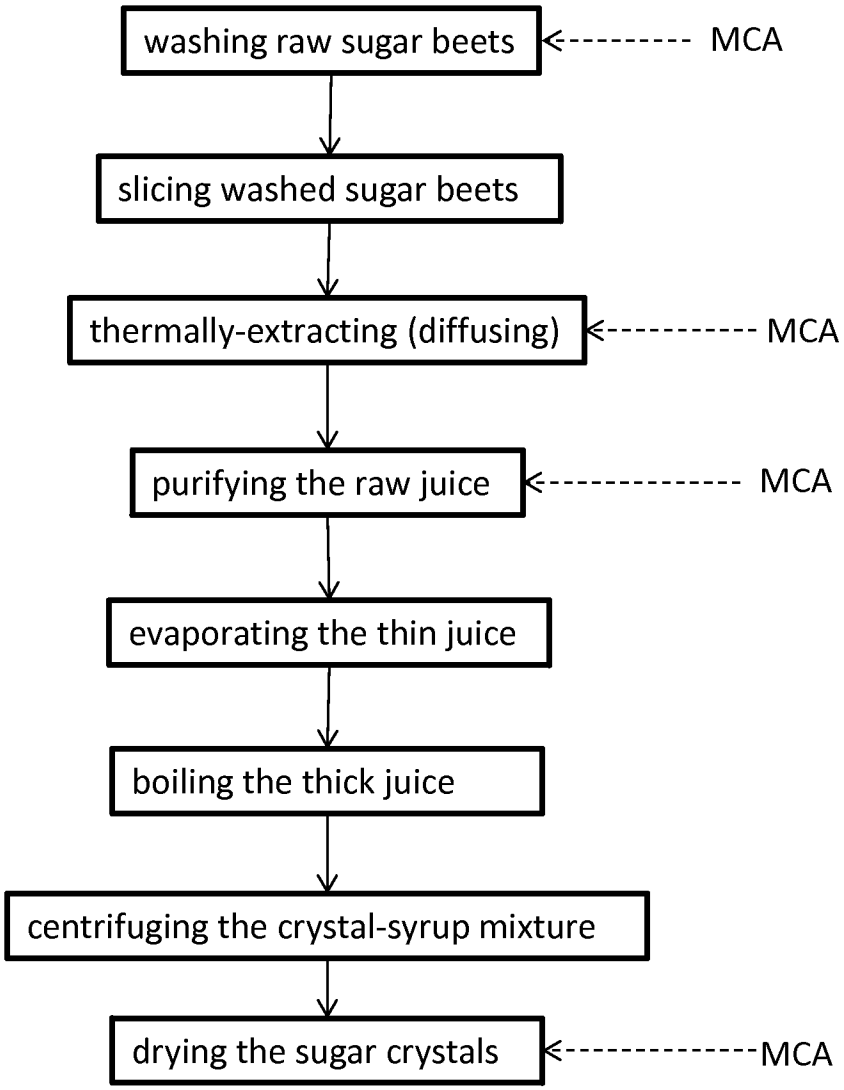
FIG. 2 is a process flow chart illustrating a method for beet sugar processing with microbiological control according to an example of the present application.

FIG. 2 is a process flow chart which shows a series of processing stages in a beet sugar processing method, such as discussed above with respect to FIG. 1, and indicates several of these stages where monochloramine preferably can be introduced. The monochloramine can be added at any one, any two, any three, or all four of the indicated MCA addition options, or at other locations. Though several additional stages are illustrated, the monochloramine can be introduced in any one or more (at least one) of the steps shown in FIG. 2. In more detail, examples of monochloramine (MCA) addition points can include the beets before slicing (e.g., spraying MCA-dosed water on beets as part of washing, or after washing and before slicing), diffuser pulp press water (e.g., MCA added before press water is recycled to the diffuser for introduction), diffusion makeup water (e.g., MCA added before introduction of the makeup water to the diffuser), a sliced beet heat exchanger (e.g., MCA added at a diffuser heat exchanger), depuration (purification) stage (e.g., MCA added to milk of lime), sugar dust catcher, molasses (e.g., MCA added to beet molasses or cane molasses to be used as a raw material for fermentation to ethanol or for other uses), stillage (vinasse) (e.g., MCA added to stillage produced as a by-product of integrated operations that include alcohol production from fermentation of beet molasses, and/or other addition locations, or any combination of these locations.

Figure 3:
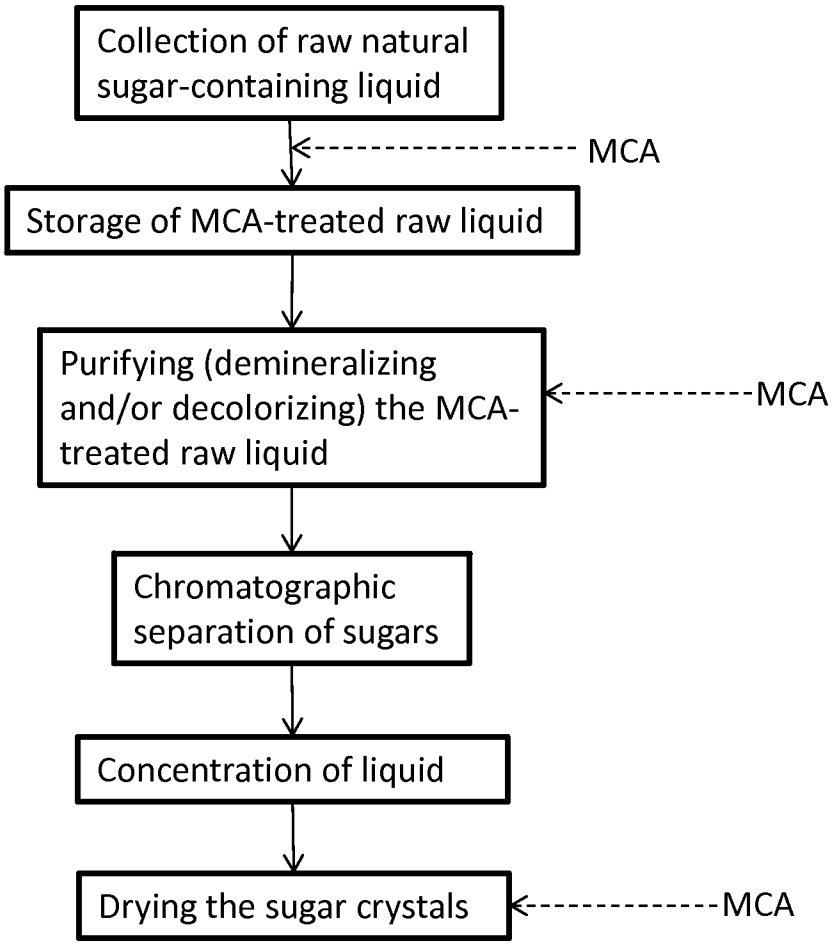
FIG. 3 is a process flow chart illustrating a method for processing of sugar-containing liquids with microbiological control according to an example of the present application.

Monochloramine can be used in a method for providing microbiological control in raw natural sugar-containing saps, juices, and/or liquors, such as the tree saps/juices, fruit juices, and the like indicated hereinabove, as a preservative to protect the saps, juices, liquors, syrups, solutions and the like (collectively referred to herein as "liquids") during storage, such as before the liquids are subjected to sugar crystal production, or other processing. The fruit liquids can contain sucrose, simple sugars (e.g., invert sugar (1:1 (by weight) mixture of fructose and glucose), monosaccharide sugars such as glucose, fructose, galactose, and the like, or any combinations thereof), which preferably can be recovered in crystalline form, liquid concentrate forms, or other forms. Referring to FIG. 3, the process flow chart illustrates a method for processing of raw natural sugar-containing liquids with microbiological control in the production of crystalline particulate sugar. As shown, monochloramine (MCA) treatment can be performed on the raw natural sugar-containing liquid (e.g., juice, sap, liquor, syrup, solution, and the like) after collection from a tree, tree part, or fruit. As shown, the MCA-treated fruit juices may be further processed to recover sugar crystals, a sugar-rich liquid concentrate, or other sugar-rich products by process steps that may include one or more of demineralization and decolorization (e.g., using ion exchange resins, absorbent resins, activated carbon, and the like, or any combinations thereof, or carbonatation/liming if sucrose is the recoverable sugar in the liquid), chromatographic separations of different sugars if present (e.g., as shown in U.S. Patent Application Publication No. 2008/0314379 A1, which is incorporated herein by reference in its entirety), evaporation/concentration, crystallization for production of dry flowable crystalline particulate sugar, or any combinations of these steps, and/or other further processing steps. As indicated in FIG. 3, the MCA treatment optionally can be used in one or more other process locations during the further processing of the treated fruit juices for recovery of sugar. The above-indicated monochloramine dosages and concentrations can be used for these treatments, or other treatment amounts that provide microbiological control.

The treatment of the sugar-containing materials or related process waters with monochloramine can be continuous, substantially continuous, intermittent, cyclic, batch, or any combination thereof. Treatment can be repeated any desired number of times and treatments can be separated by constant or variable time periods. The rate of addition of monochloramine and/or precursors can be constant or variable. Monochloramine can be topically applied, non-topically applied, or both, to sugar-containing plant material in sugar production to provide microbiological control. Monochloramine can be added in any manner to the sugar-containing materials or process water, for example, by pouring, by nozzle, by spraying, by misting, by curtain, by weir, by fountain, by percolation, by mixing, by injection, or by any combination thereof. For topical treatment, monochloramine can be sprayed in an aqueous form on a sugar-containing plant raw material. The monochloramine can be added in an aqueous dilute form to process water used in the sugar production process that contacts or is brought into contact with at least one of the sugar-containing plant raw material or the component derived therefrom.

The sugar-containing material or process water can be treated for any period of time. For instance, on a substantially continuous or continuous basis, such as at least about 6.0 hours, at least about 12 hours, at least about 24 hours, at least about 36 hours, or at least about at least 7 days, at least 2 weeks, at least 1 month, at least 2 months, at least 3 months, from 1 day to 6 months, from 1 day to 12 months or more. The amount of monochloramine added may be varied based on any one or combination of different process factors.

The present invention includes the following aspects/embodiments/features in any order and/or in any combination:

1. A method for producing sugar from sugar-containing plant material with microbiological control, comprising treating at least one of a sugar-containing plant raw material, a component derived therefrom, or a medium containing at least one of the plant raw material and the component, with monochloramine.

2. The method of any preceding or following embodiment/feature/aspect, wherein the sugar-containing plant raw material is sugar beet, sugar cane, maize, sorghum, sugar palm sap or juice, maple tree sap or juice, coconut sugar, nectarines, pineapples, mangoes, jackfruit, peaches, cantaloupe, apricots, bananas, grapes, apples, pears, cherries, oranges, or any combination thereof.

3. The method of any preceding or following embodiment/feature/aspect, wherein the monochloramine is dosed in a system in which the method is performed at a dosage of from about 1 g to about 1000 g monochloramine per ton of sugar-containing plant raw material.

4. The method of any preceding or following embodiment/feature/aspect, wherein the monochloramine is added in an aqueous diluted form.

5. The method of any preceding or following embodiment/feature/aspect, wherein the monochloramine is added in an aqueous diluted form at a concentration of from about 100 ppm to about 15,000 ppm.

6. The method of any preceding or following embodiment/feature/aspect, wherein the monochloramine is sprayed in an aqueous form on the sugar-containing plant raw material.

7. The method of any preceding or following embodiment/feature/aspect, wherein the monochloramine is added in an aqueous form to process water that contacts or is brought into contact with the at least one of the sugar-containing plant raw material, the component derived therefrom, or the medium containing at least one of the plant raw material and the component derived therefrom.

8. A method for processing beet sugar in sugar production with microbiological control, comprising treating at least one of beet sugar raw material, a component derived therefrom, or a medium containing at least one of the beet sugar raw material and the component, with monochloramine.

9. The method of any preceding or following embodiment/feature/aspect, wherein the monochloramine is dosed in a system in which the method is performed at a dosage of from about 1 g to about 1000 g monochloramine per dry ton of beet sugar raw material.

10. The method of any preceding or following embodiment/feature/aspect, wherein the monochloramine is added in an aqueous diluted form.

11. The method of any preceding or following embodiment/feature/aspect, wherein the monochloramine is added in an aqueous diluted form at a concentration of from about 100 ppm to about 15,000 ppm.

12. The method of any preceding or following embodiment/feature/aspect, which comprises controlling at least one microorganism with the monochloramine, wherein the microorganism is *Leuconostoc mesenteroides, lactobalillus*, and/or *coccus* species, or any combination thereof.

13. The method of any preceding or following embodiment/feature/aspect, which further comprises the steps of washing raw sugar beets, slicing the washed sugar beets, thermally-extracting sugar-containing plant parts from the sliced sugar beets as raw juice, purifying the raw juice to produce thin juice, evaporating the thin juice to produce thick juice, boiling the thick juice to form a crystal-syrup mixture, centrifuging to separate the sugar crystals from syrup, and drying the sugar crystals, wherein the monochloramine is introduced in at least one of the steps.

14. The method of any preceding or following embodiment/feature/aspect, wherein the monochloramine is introduced in more than one of the steps.

15. The method of any preceding or following embodiment/feature/aspect, wherein monochloramine treatment is performed on the beets before slicing, on diffuser pulp press water, on diffusion makeup water, at a sliced beet heat exchanger, at a depuration (purification) stage, at a sugar dust catcher, in molasses by-product, on stillage (vinasse), or any combination thereof.

16. The method of any preceding or following embodiment/feature/aspect, wherein the monochloramine is prepared on-site where the method is performed by reacting ammonia or an ammonium salt with sodium hypochlorite.

The present invention can include any combination of these various features or embodiments above and/or below as set forth in sentences and/or paragraphs. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method for producing sugar from sugar-containing plant material with microbiological control, comprising treating of a sugar-containing plant raw material or a medium containing the sugar-containing plant raw material, with monochloramine, wherein the sugar-containing plant raw material is a sugar-containing vegetable material, a sugar-containing fruit material, a sugar-containing tree sap/juice, or other sugar-containing plant material, separately or in any combination thereof, wherein the monochloramine is dosed in a system in which the method is performed at a dosage of from about 1 g to about 1000 g monochloramine per ton of sugar-containing plant raw material, wherein the treating comprises adding the monochloramine to the sugar-containing plant raw material or the medium at the dosage, and wherein the microbiological control reduces bacteria count of bacteria that consume sugar.

2. The method of claim 1, wherein the sugar-containing plant raw material is sugar beet, sugar cane, maize, sorghum, sugar palm sap or juice, maple tree sap or juice, coconuts, nectarines, pineapples, mangoes, jackfruit, peaches, cantaloupe, apricots, bananas, grapes, apples, pears, cherries, oranges, or any combination thereof.

3. The method of claim 1, wherein the monochloramine is added in an aqueous diluted form.

4. The method of claim 1, wherein the monochloramine is added in an aqueous diluted form at a concentration of from about 100 ppm to about 15,000 ppm.

5. The method of claim 1, wherein the adding comprises spraying the monochloramine in an aqueous form on the sugar-containing plant raw material.

6. The method of claim 1, wherein the monochloramine is added in an aqueous form to process water that contacts or is brought into contact with the sugar-containing plant raw material or the medium containing the plant raw material.

7. The method of claim 1, wherein the monochloramine is added at multiple addition points and the dosage is a total dosage for all addition points.

8. A method for processing beet sugar in sugar production with microbiological control, comprising treating beet sugar raw material or a medium containing the beet sugar raw material with monochloramine, wherein the monochloramine is dosed in a system in which the method is performed at a dosage of from about 1 g to about 1000 g monochloramine per dry ton of beet sugar raw material, wherein the treating comprises adding the monochloramine to the beet sugar raw material or the medium at the dosage, and wherein the microbiological control reduces bacteria count of bacteria that consume sugar.

9. The method of claim 8, wherein the monochloramine is added in an aqueous diluted form.

10. The method of claim 8, wherein the monochloramine is added in an aqueous diluted form at a concentration of from about 100 ppm to about 15,000 ppm.

11. The method of claim 8, which comprises controlling microorganisms with the monochloramine, wherein the microorganisms are selected from *Leuconostoc mesenteroides, lactobalillus*, and *coccus* species, or any combination thereof.

12. The method of claim 8, which further comprises the steps of washing raw sugar beets, slicing the washed sugar beets, thermally-extracting sugar-containing plant parts from the sliced sugar beets as raw juice, purifying the raw juice to produce thin juice, evaporating the thin juice to produce thick juice, boiling the thick juice to form a crystal-syrup mixture, centrifuging to separate the sugar crystals from syrup, and drying the sugar crystals, wherein the monochloramine is added introduced in at least one of the steps.

13. The method of claim 12, wherein the monochloramine is added in more than one of the steps.

14. The method of claim 8, wherein monochloramine treatment is performed on the beets before slicing, on diffuser pulp press water, on diffusion makeup water, at a sliced beet heat exchanger, at a depuration (purification) stage, at a sugar dust catcher, in molasses by-product, on stillage (vinasse), or any combination thereof.

15. The method of claim 8, wherein the monochloramine is formed on-site before adding to the beet sugar raw material or the medium, and wherein the monochloramine is formed by reacting ammonia or an ammonium salt with sodium hypochlorite.

16. The method of claim 8, wherein the monochloramine is added at multiple addition points and the dosage is a total dosage for all addition points.

* * * * *